US006402797B1

(12) United States Patent
Lin et al.

(10) Patent No.: US 6,402,797 B1
(45) Date of Patent: Jun. 11, 2002

(54) FUEL OIL COMPOSITIONS

(75) Inventors: Jian Lin, Upton-By-Chester; Struan Douglas Robertson, Chester, both of (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/298,578

(22) Filed: Jul. 28, 1999

Related U.S. Application Data

(62) Division of application No. 08/890,810, filed on Jul. 11, 1997, now Pat. No. 5,997,592.

(30) Foreign Application Priority Data

May 7, 1996 (EP) ..... 96304975

(51) Int. Cl.[7] ..... C10L 1/18
(52) U.S. Cl. ..... 44/385; 44/400; 44/410
(58) Field of Search ..... 44/385, 400, 410

(56) References Cited

U.S. PATENT DOCUMENTS

| | | | | |
|---|---|---|---|---|
| 3,541,723 | A | 11/1970 | Eckert | 44/385 |
| 4,828,733 | A | 5/1989 | Farng et al. | 524/582 |
| 5,482,521 | A | 1/1996 | Avery et al. | 44/344 |
| 5,484,462 | A | 1/1996 | Herbstman | 44/334 |
| 5,490,864 | A | 2/1996 | Herbstman et al. | 44/379 |
| 5,522,906 | A | 6/1996 | Hashimoto et al. | 44/400 |

FOREIGN PATENT DOCUMENTS

| | | |
|---|---|---|
| DE | 1545507 | 11/1969 |
| DE | 1745911 | 11/1971 |
| FR | 1232157 | 10/1960 |
| GB | 911491 | 11/1962 |
| GB | 1324162 | 7/1973 |
| JP | 05070781 | * 3/1993 |
| WO | WO 94/17160 | 8/1994 |
| WO | WO 95/33805 | 12/1995 |

* cited by examiner

*Primary Examiner*—Margaret Medley
*Assistant Examiner*—Cephia D. Toomer

(57) ABSTRACT

This invention provides a fuel oil composition comprising a major amount of a fuel oil and a minor amount of an additive comprising at least one fuel oil-soluble alkyl or alkoxy aromatic compound wherein at last one group independently selected from alkyl and alkoxy groups of 1 to 30 carbon atoms is attached to an aromatic nucleus and at least one carboxyl group and optionally one or two hydroxyl groups are attached to the aromatic nucleus; a process for the preparation of such a fuel oil composition; and the use of such a fuel oil composition as fuel in a compression-ignition engine for controlling wear rate in the fuel injection system thereof.

6 Claims, No Drawings

FUEL OIL COMPOSITIONS

This is a division, of application Ser. No. 08/890,810 filed Jul. 11, 1997, now U.S. Pat. No. 5,997,592.

FIELD OF THE INVENTION

The present invention relates to fuel oil compositions, processes for their preparation, and their use in compression-ignition engines.

BACKGROUND OF THE INVENTION

As stated in WO 9533805 (Exxon) environmental concerns have led to a need for fuels with reduced sulphur content, especially diesel fuel and kerosene. However, the refining processes that produce fuels with low sulphur contents also result in a product of lower viscosity and a lower content of other components in the fuel that contribute to its lubricity, for example, polycyclic aromatics and polar compounds. Furthermore, sulphur-containing compounds in general are regarded as providing anti-wear properties and a result of the reduction in their proportions, together with the reduction in proportions of other components providing lubricity, has been an increase in reported failures of fuel pumps in diesel engines using low-sulphur fuels, the failure being caused by wear in, for example, cam plates, rollers, spindles and drive shafts.

This problem may be expected to become worse in the future because, in order to meet stricter requirements on exhaust emissions generally, high pressure fuel pumps, for example rotary and unit injector systems, are being introduced, these being expected to have more stringent lubricity requirements than present equipment, at the same time as lower sulphur levels in fuels become more widely required.

At present, a typical sulphur content in a diesel fuel is about 0.25% by weight (2500 ppmw). In Europe maximum sulphur levels are being reduced to 0.20% (2000 ppmw), and are expected to be reduced to 0.05% (500 ppmw); in Sweden grades of fuel with levels below 0.005% (50 ppmw) (Class 2) and 0.001% (10 ppmw) (Class 1) are already being introduced. Fuel oil compositions with a sulphur level below 0.20% by weight (2000 ppmw) may be referred to as a low-sulphur fuels.

WO 95 33805 (Exxon) describes the use of cold flow improvers to enhance lubricity of low-sulphur fuels.

WO 94 17160 (Exxon) describes the use of certain esters of a carboxyclic acid and an alcohol wherein the acid has from 2 to 50 carbon atoms and the alcohol has one or more carbon atoms, particularly glycerol monooleate and di-isodecyl adipate, as additives for fuel oils for wear reduction in the injection system of a compression-ignition engine.

U.S. Pat. No. 5,484,462 (Texaco) mentions dimerized linoleic acid as a commercially available lubricity agent for low sulphur diesel fuel (Col. 1, line 38), and itself provides aminoalkylmorpholines as fuel lubricity improvers.

U.S. Pat. No. 5,490,864 (Texaco) describes certain dithiophosphoric diester-dialcohols as anti-wear lubricity additives for low-sulphur diesel fuels.

SUMMARY OF THE INVENTION

It has now surprisingly been found that certain alkyl and alkoxy aromatic compounds having at least one carboxyl group attached to their aromatic nuclei can confer anti-wear lubricity effects when incorporated in fuel oil.

According to the present invention therefore there is provided a fuel oil composition comprising a major amount of a fuel oil and a minor amount of an additive comprising at least one fuel oil soluble alkyl or alkoxy aromatic compound wherein at least one group independently selected from alkyl and alkoxy groups of 1 to 30 carbon atoms is attached to an aromatic nucleus and at least one carboxyl group and optionally one or two hydroxyl groups are attached to the aromatic nucleus.

DETAILED DESCRIPTION OF THE INVENTION

The fuel oil may be derived from petroleum or from vegetal sources or a mixture thereof. It may conveniently be a middle distillate fuel oil having a boiling range in the range 100° C. to 500° C., e.g. 150° C. to 400° C. Petroleum-derived fuel oils may comprise atmospheric distillate or vacuum distillate, or cracked gas oil or a blend in any proportion of straight run and thermally and/or catalytically cracked distillates. Fuel oils include kerosine, jet fuels, diesel fuels, heating oils and heavy fuel oils. Preferably the fuel oil is a diesel oil, and preferred fuel oil compositions of the invention are thus diesel fuel compositions. Diesel fuels typically have initial distillation temperature of about 160° C. and final distillation temperature of 290–360° C., depending on fuel grade and use.

A fuel oil, e.g. diesel oil, itself may be an additised (additive-containing) oil or an unadditised (additive-free) oil. If the fuel oil, e.g. diesel oil, is an additised oil, it will contain minor amounts of one or more additives, e.g. one or more additives selected from anti-static agents, pipeline drag reducers, flow improvers (e.g. ethylene/vinyl acetate copolymers or acrylate/maleic anhydride copolymers) and wax anti-settling agents (e.g. those commercially available under the Trade Marks "PARAFLOW" (e.g. "PARAFLOW" 450; ex Paramins), "OCTEL" (e.g. "OCTEL" W 5000; ex Octel) and "DODIFLOW" (e.g. "DODIFLOW" v 3958; ex Hoechst).

Preferably the fuel oil is a middle distillate oil, e.g. a diesel oil, having a sulphur content of at most 0.2% by weight (2000 ppmw) ("ppmw" is parts per million by weight), more preferably at most 0.05% by weight (500 ppmw). Advantageous compositions of the invention are also attained when the sulphur content of the fuel oil is below 0.005% by weight (50 ppmw) or even below 0.001% by weight (10 ppmw).

Although the aromatic nucleus of the alkyl or alkoxy aromatic compound may be monocyclic, bicyclic or polycyclic, e.g. a benzene ring or a naphthalene ring system, the aromatic nucleus is preferably a benzene ring.

Preferred alkyl and alkoxy aromatic compounds are those in which whenever there are less than three groups selected from alkyl and alkoxy groups attached to the aromatic nucleus, there is at least one group selected from alkyl and alkoxy groups of 2 to 30 carbon atoms attached to said nucleus.

In one preferred aspect of the present invention, the at least one alkyl or alkoxy aromatic compound is an alkyl aromatic compound wherein at least one alkyl group of 6 to 30 carbon atoms is attached to the aromatic nucleus.

More preferably, the alkyl aromatic compound is an alkyl benzoic acid or an alkyl salicylic acid containing one or two alkyl groups of 6 to 30 carbon atoms.

The or each alkyl group in the alkyl aromatic compound is preferably a $C_{8-22}$ alkyl group, most preferably a $C_{8-18}$ alkyl group.

The alkyl or alkoxy aromatic compounds incorporated in fuel oil compositions of the present invention are either known compounds or can be prepared by methods analogous to methods used for preparing known compounds, as will readily be appreciated by those skilled in the art.

Preferred alkyl salicylic acids may be very readily be prepared by the methods described in UK Patent 1,146,925, incorporated herein by reference. (In that patent, the alkyl salicylic acids are intermediates in the preparation of polyvalent metal salts used as dispersants in lubricant compositions).

The additive comprising the at least one alkyl or alkoxy aromatic compound is preferably present in an amount in the range 50 to 500 ppmw, more preferably 50 to 250 ppmw, most preferably 150 to 250 ppmw, based on the total weight of the fuel composition.

Fuel oil compositions in accordance with the invention may be prepared by a process for their preparation which comprises admixing the additive or an additive concentrate containing the additive-with the fuel oil.

Additive concentrates suitable for incorporating in the fuel oil compositions (preferably diesel fuel compositions) will contain the additive comprising the at least one alkyl aromatic compound and a fuel-compatible diluent, which may be a carrier oil (e.g. a mineral oil), a polyether, which may be capped or uncapped, a non-polar solvent such as toluene, xylene, white spirits and those sold by member companies of the Royal Dutch/Shell Group under the Trade Mark "SHELLSOL", and/or a polar solvent such as esters and, in particular, alcohols, e.g. hexanol, 2-ethylhexanol, decanol, isotridecanol and alcohol mixtures such as those sold by member companies of the Royal Dutch/Shell Group under the Trade Mark "LINEVOL", especially "LINEVOL" 79 alcohol which is a mixture of $C_{7-9}$ primary alcohols, or the $C_{12-14}$ alcohol mixture commercially available from Sidobre Sinnova, France under the Trade Mark "SIPOL".

Additive concentrates and fuel oil compositions prepared therefrom may further contain additional additives such as ashless detergents or dispersants, e.g. linear or branched hydrocarbyl amines, for example alkylamines, hydrocarbyl-substituted succinimides, such as those described in EP-A-147 240, preferably the reaction product of a polyisobutylene succinic acid or anhydride with tetraethylene pentamine wherein the polyisobutylene substituent has a number average molecular weight (Mn) in the range 500 to 1200, and/or an alkoxy acetic acid derivative as described in European Application No. 96302953.3 (Applicant's reference TS 7030 EPC); dehazers, e.g. alkoxylated phenol formaldehyde polymers such as those commercially available as "NALCO" (Trade Mark) EC5462A (formerly 7D07) (ex Nalco), and "TOLAD" (Trade Mark) 2683 (ex Petrolite); anti-foaming agents (e.g. the polyether-modified polysiloxanes commercially available as "TEGOPREN" (Trade Mark) 5851, Q 25907 (ex Dow. Coming) or"RHODORSIL" (ex Rhone Poulenc)); ignition improvers (e.g. 2-ethylhexyl nitrate, cydohexyl nitrate, di-tertiarybutyl peroxide and those disclosed in U.S. Pat. No. 4,208,190, incorporated herein by reference, at Column 2, line 27 to Column 3, line 21); anti-rust agents (e.g. that commercially sold by Rhein Chemie, Mannheim, Germany as "RC 4801", or polyhydric alcohol esters of a succinic acid-derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid), reodorants, anti-wear additives; anti-oxidants (e.g. phenolics such as 2,6-di-tert-butylphenol, or phenylenediamines such as N,N'-di-sec-butyl-p-phenylenediamine); and metal deactivators.

Unless otherwise stated, the (active matter) concentration of each additional additive in the diesel fuel is preferably up to 1 percent by weight, more preferably in the range from 5 to 1000 ppmw (parts per million by weight of the diesel fuel). The (active matter) concentration of the detergent or dispersant in the diesel fuel is preferably 30 to 1000 ppmw, more preferably 50 to 600 ppmw, advantageously 75 to 300 ppmw e.g. 95 to 150 ppmw.

The (active matter) concentration of the dehazer in the diesel fuel is preferably in the range from 1 to 20 ppmw, more preferably from 1 to 15 ppmw, still more preferably from 1 to 10 ppmw and advantageously from 1 to 5 ppmw. The (active matter) concentrations of other additives (with the exception of the ignition improver are each preferably in the range from 0 to 20 ppmw, more preferably from 0 to 10 ppmw. The (active matter) concentration of the ignition improver in the diesel fuel is preferably in the range from 0 to 600 ppmw and more preferably from 0 to 500 ppmw. If an ignition improver is incorporated into the diesel fuel, it may conveniently be used in an amount of 300 to 500 ppmw.

The invention further provides the use of a fuel composition as defined above as fuel in a compression-ignition engine for controlling wear rate in the fuel injection system of the engine, especially in fuel injection pumps and/or fuel injectors.

This latter aspect of the invention may also be expressed as a method of operating a compression-ignition engine which comprises providing a fuel composition as defined above as the fuel in the engine thereby to control wear rate in the fuel injection system of the engine, especially the fuel injection pump and/or fuel injectors.

The invention will be further understood from the following illustrative examples which are included for illustrative purposes only and are in no way intended to limit the present invention.

EXAMPLES

The base fuels and additive components were as follows:

| | Base Fuel 1 | Base Fuel 2 | Base Fuel 3 | Base Fuel 4 |
|---|---|---|---|---|
| Density (kg/l) at 15° C. (ASTM D 4052) | 0.821 | 0.8291 | 0.8165 | 0.8165 |
| Sulphur (ppmw) (IP 373) | 182 | 145 | 2 | <5 |
| Distillation, degrees C. (ASTM D 86) | | | | |
| IBP | 166.5 | 167 | 184.5 | 184.5 |
| 10% | 203.5 | 199 | 213 | 206.5 |
| 20% | 216 | 210.5 | 218.5 | 213.5 |
| 50% | 256.5 | 247.5 | 238 | 235.5 |
| 90% | 322.5 | 309.5 | 269.5 | 268.5 |
| 95% | 342.5 | 324.5 | 278.5 | 277.5 |
| FBP | 355 | 338.5 | 292 | 290 |
| Total Aromatics content (% w) | 20.2 | 22.1 | 5.2 | 3.8 |

"Akysalicylic acid A" was prepared from $C_{14-18}$ alkyphenol by phenation, carboxylation and hydrolysis, as described in UK Patent 1,146,925. The starting alkylphenol was prepared from a mixture of olefins (C14:C16:C18 weight ratio 1:2:1), by reacting phenol and the olefins (molar ratio 5:1)

in the presence of 3% w, based on the olefins, of acid-activated montmorillonite catalyst at 190° C. and 0.4 bar ($4\times10^4$ Pa) pressure, with excess phenol being removed by distillation. The end-product $C_{14-18}$ alkylsalicylic acid contained 71.5% mol monoalkysalicylic acid, 17.2% mol monoalkyl phenol, and 4.7% mol dialkylphenol, the balance being minor quantities of 4-hydroxyiso-phthalic acid, dialkyl salicylic acid, 2-hydroxyiso-phthalic acid and alkyl phenyl ether.

"Carrier B" is a polyoxypropylene glycol hemiether (monoether) prepared using a mixture of $C_{12-15}$ alcohols as initiator, and having $M_n$ in the range 1200 to 1500 and a kinematic viscosity in the range 72 to 82 $mm^2/s$ at 40° C. according to ASTM D 445, available under the trade designation "SAP 949" from member companies. of the Royal Dutch/Shell group.

"Oil C" is a clear and bright solvent refined base oil having viscosity at 100° C. of 4.4 to 4.9 $mm^2/s$, pour point −18° C., and flash point 204° C., available under the trade designation "HVI 60" from member companies of the Royal Dutch/Shell group.

"Anti-Rust Agent D" is a hydroxypropyl ester of tetrapropenyl succinic acid (propane-1,2-diol semi-ester of tetrapropenyl succinic acid) (cf. Example IV of U.K Patent 1,306,233, incorporated herein by reference).

Dehazer E" is an alkoxylated phenol formaldehyde polymer dehazer available ex Nalco as "NALCO" EC5462A (formerly 7D07) (trade mark).

"Antifoaming Agent F" is a polyether-modified siloxane available ex Th. Goldschmidt AG as "TEGOPREN 5851" (trade mark).

"Solvent G" is a blend of $C_{7-9}$ primary alcohols available from member companies of the Royal Dutch/Shell group as "LINEVOL 79" (trade marks).

"Solvent H" is an aromatic hydrocarbon solvent (74% aromatic) of boiling range 205 to 207° C. and average molecular weight 156, available from member companies of the Royal Dutch/Shell group as "SHELLSOL R" (trade mark).

"Dispersant I" is a 27% w solution of polyisobutylene succinimide prepared by reaction of a polyisobutylene of number average molecular weight (Mn) 950 with maleic anhydride, to yield a polyisobutylene succinic anhydride product having a succination ratio (ratio of succinic anhydride moieties per polyisobutylene chain) 1.05:1, followed by reaction of the anhydride product with tetraethylene pentamine (TEPA) in molar ratio succinic groups: TEPA 1.5:1. A solution of the polyisobutylene succinimide containing 47% w active ingredient in "HVI 60" base oil is diluted to the active ingredient concentration of 27% w by addition of "SHELLSOL R" (trade mark) solvent, for ease of handling:

Example I

An additive concentrate was prepared by mixing 69 g of a solution of alkylsalicylic acid. A (45g) in xylene (24 g), 16 g of Oil C and 15 g of Carrier B, in a sealed 250 ml glass bottle for 1 hour on a rotary mixer at ambient temperature (20° C.) to give 100 g of well mixed additive concentrate I.

Example II

A co-additive mixture was prepared by mixing together 0.3319 g of Anti-Rust Agent D, 0.3325 g of Dehazer E, 0.6791 g of Antifoaming Agent F, 6.6739 g of Solvent G. 12.8809 g of Solvent H, 32.44 g of Dispersant I and 33.66 g of 2-ethylhexyinitrate (ignition improver).

1.0498 g of the resulting co-additive mixture was then mixed in a 250 ml glass beaker with 0.1620 g of the additive concentrate I of Example I to yield additive concentrate II.

When additive concentrate II was used to prepare a formulated diesel fuel, 50 ml of Base Fuel 1 was added to the above sample of additive concentrate II and the resulting mixture was stirred thoroughly before being poured into a 1 liter lacquer-lined can. The glass beaker was then rinsed with another 50 ml portion of Base Fuel 1 into the same can. Total weight of formulated fuel was made up to 801 g by addition of Base Fuel 1. The can was shaken for 2 minutes to yield a homogeneous formulated diesel fuel containing 1500 ppmw of additive concentrate II.

Example III

An additive concentrate was prepared by mixing 45 g of Alkylsalicylic acid A with 24 g of Solvent H. 16 g of Oil C and 15 g of Carrier B. by a procedure similar to that of Example I to yield additive concentrate III.

Example IV

An additive concentrate was prepared similarly to Example III by mixing 45 g of Alkylsalicylic acid A with 39 g of Solvent A and 16 g of Oil C to yield additive concentrate IV.

Fuel Test Examples

Formulated diesel fuels were prepared by adding quantities of the additive concentrates I, III and IV to various of the Base Fuels 1, 2 and 3. The resulting fuels were tested for lubricity performance by the High Frequency Reciprocating Rig (HFRR) test, according to the procedure of CEC F-06-T-94 (Co-ordinating European Council for Development of Performance Test for Lubricants and Engine Fuels) with the exception that the value of fuel used was 2 ml and the fluid temperature was 60° C.

Details of the formulated diesel fuels tested, and results of the tests, are given in Table 1 following:

TABLE 1

| Fuel Example | Base Fuel | Additive Concentrate (AC) | Concentration of AC in Fuel (ppmw) | Concentration of Alkyl salicylic Acid A in Fuel (ppmw) | Average wear scar diameter (microns, m × $10^{-6}$) |
|---|---|---|---|---|---|
| Comparative A | 1 | — | — | — | 597 |
| 1 | 1 | I | 110 | 50 | 472 |
| 2 | 1 | I | 170 | 75 | 429 |
| 3 | 1 | I | 225 | 100 | 415 |
| 4 | 1 | I | 335 | 150 | 396 |
| 5 | 1 | I | 445 | 200 | 398 |

TABLE 1-continued

| Fuel Example | Base Fuel | Additive Concentrate (AC) | Concentration of AC in Fuel (ppmw) | Concentration of Alkyl salicylic Acid A in Fuel (ppmw) | Average wear scar diameter (microns, m × $10^{-6}$) |
|---|---|---|---|---|---|
| 6 | 1 | II | 1500 | 90 | 483 |
| 7 | 1 | IV | 225 | 100 | 378 |
| Comparative B | 2 | — | — | — | 610 |
| 8 | 2 | III | 110 | 50 | 518 |
| 9 | 2 | III | 170 | 75 | 461 |
| 10 | 2 | III | 225 | 100 | 440 |
| 11 | 2 | III | 335 | 150 | 390 |
| 12 | 2 | IV | 225 | 100 | 434 |
| Comparative C | 3 | — | — | — | 660 |
| 13 | 3 | III | 170 | 75 | 539 |
| 14 | 3 | III | 340 | 150 | 391 |
| 15 | 3 | III | 510 | 230 | 383 |

It can readily be seen from the results in Table 1 that even at low treat rates surprisingly enhanced lubricity, as evidenced by wear reduction, is attained even at low concentrations of Alkylsalicycdic Acid A Further Fuel Test Examples Further diesel fuels were prepared by adding quantities of a number of different alkyl aromatic compounds to Base Fuel 1 to concentrations of 100 ppmw. The resulting fuels were tested for lubricity performance as described in the fuel test examples above, except that a different, although similar pattern, rig was used (this accounts for the small, and insignificant, difference in wear scar for the base fuel test Comparative D relative to that of Comparative A above).

The alkyl aromatic compounds used were as follows:

Example 16

4ocylbenzoic acid

Example 17

4-n-butylbenzoic acid

Example 18

4-dodecyloxybenzoic acid

Comparative E 3-pentadecyl phenol

Comparative F dodecylphenol, available ex Adibis under the trade designation "ADX 100".

Comparative G $C_{14-18}$ alkylphenol, the starting alkylphenol of alkylsalicylic acid A described above.

Results are given in Table 2 following:

TABLE 2

| Fuel Example | Average wear scar diameter (microns, m × $10^{-6}$) |
|---|---|
| Comparative D (no additive) | 565 |
| Example 16 | 308 |

TABLE 2-continued

| Fuel Example | Average wear scar diameter (microns, m × $10^{-6}$) |
|---|---|
| Example 17 | 250 |
| Example 18 | 319 |
| Comparative E | 562 |
| Comparative F | 559 |
| Comparative G | 559 |

Directly equivalent tests to those of Table 2 were done using base fuel 4 (Comparative H) and 200 ppmw concentrations of 2,4,6-rimethylbenzoic acid (Example 19) and 4-ethylbenzoic acid (Example 20). Results are given in Table 3 following:

TABLE 3

| Fuel Example | Average wear scar diameter (microns, m × $10^{-6}$) |
|---|---|
| Comparative H (no additive) | 622 |
| Example 19 | 387 |
| Example 20 | 352 |

It can readily be seen from Tables 2 and 3 that surprisingly enhanced lubricity was obtained for the fuel containing the alkyl or alkoxy benzoic acids (4-octylbenzoic acid, 4-n-butylbenzoic acid, 4dodecyloxybenzoic acid, 2,4,6-trimethylbenzoic acid and 4ethylbenzoic acid), whereas no positive effect was found in the case of any of the alkylphenols.

2,3-Dimethylbenzoic acid, 2,4-dimethylbenzoic acid and 3,4-dimethylbenzoic acid were each tested for solubility at a concentration of 50 ppmw in fuel oil, specifically Base Fuel 4, and were found to be insoluble at ambient temperature (20° C.). These dimethylbenzoic acids are thus not fuel oil-soluble alkyl aromatic compounds.

What is claimed is:

1. A fuel oil composition comprising a major amount of a middle distillate fuel oil having a sulfur content of at most 0.05% by weight and a minor amount of an antiwear lubricity additive consisting essentially of 50 to 500 ppmw of at least one fuel oil-soluble alkyl or alkoxy aromatic compound wherein at least one alkyl group independently selected from alkyl and alkoxy groups of 1 to 30 carbon atoms is attached to an aromatic nucleus and one carboxyl group and optionally one or two hydroxyl groups are attached to the aromatic nucleus, said lubricity additive being effective to reduce the wear rate of a diesel engine injection system operated with the fuel oil composition.

2. The composition of claim 1 wherein there are less than three groups selected from alkyl and alkoxy groups attached to the aromatic nucleus, there is at least one group selected from alkyl and alkoxy groups of 2 to 30 carbon atoms attached to said nucleus.

3. The composition of claim 1 wherein the at least one alkyl or alkoxy aromatic compound is an alkyl aromatic compound wherein at least one alkyl group of 6 to 30 carbon atoms is attached to the aromatic nucleus.

4. The composition, of claim 1 wherein in the alkyl or alkoxy aromatic compound the aromatic nucleus is a benzene ring.

5. The composition of claim 4 wherein the alkyl aromatic compound is an alkyl benzoic acid or an alkyl salicylic acid containing one or two alkyl groups of 6 to 30 carbon atoms.

6. The composition of claim 1 wherein the or each alkyl group is a $C_{8-22}$ alkyl group.

* * * * *